US005564562A

United States Patent [19]

Focke et al.

[11] Patent Number: 5,564,562

[45] Date of Patent: Oct. 15, 1996

[54] PACKAGE FOR PAPER HANDKERCHIEFS

[75] Inventors: Heinz Focke; Oskar Balmer, both of Verden, Germany

[73] Assignee: Focke & Co. (GmbH & Co.), Verden, Germany

[21] Appl. No.: 547,316

[22] Filed: Oct. 24, 1995

Related U.S. Application Data

[63] Continuation of Ser. No. 270,800, Jul. 5, 1994, abandoned, which is a continuation of Ser. No. 992,820, Dec. 15, 1992, abandoned.

[30] Foreign Application Priority Data

Dec. 16, 1991 [DE] Germany ..... 41 41 518.3

[51] Int. Cl.[6] ..... B65D 75/00; B43M 7/00

[52] U.S. Cl. ..... 206/233; 206/494; 206/812; 383/87; 383/120

[58] Field of Search ..... 206/494, 812, 206/581, 260, 273, 233, 38, 37; 383/84, 86, 87, 98, 99, 120; 229/87.13

[56] References Cited

U.S. PATENT DOCUMENTS

| | | | |
|---|---|---|---|
| 3,557,853 | 1/1971 | Jones . | |
| 4,540,091 | 9/1985 | Habock | 206/494 |
| 5,018,625 | 5/1991 | Focke et al. | 206/494 X |
| 5,184,725 | 2/1993 | Reinheimer et al. | 206/494 |

FOREIGN PATENT DOCUMENTS

| | | |
|---|---|---|
| 293360 | 11/1988 | European Pat. Off. . |
| 393395 | 10/1990 | European Pat. Off. . |
| 392224 | 10/1990 | European Pat. Off. . |
| 2523924 | 2/1983 | France . |
| 1955845 | 2/1967 | Germany . |
| 3324490 | 11/1984 | Germany . |
| 8319608 | 12/1984 | Germany . |
| 3416984 | 11/1985 | Germany . |
| 9006537 | 9/1990 | Germany . |
| 3920065 | 10/1990 | Germany . |
| 90 14065.6 | 4/1991 | Germany . |
| 9103648 | 8/1991 | Germany . |
| 91 09814.9 | 11/1991 | Germany . |

*Primary Examiner*—Jacob K. Ackun

*Attorney, Agent, or Firm*—Sughrue, Mion, Zinn, Macpeak & Seas

[57] ABSTRACT

A package for stacks of folded paper handkerchiefs is disclosed. Paper handerkchiefs (10) and similar cellulose products are offered in soft packs. An outer wrapper (blank 11) is made of paper or a (plastic) foil. A withdrawal opening (19) in the region of a front wall (12) is substantially smaller in width than the front wall (12). Likewise, a closure flap (23) which covers the withdrawal opening (19) in the closed position is smaller in width than the front wall (12), so that any variations in the measurements of the packages do not lead to undesired package configurations. The closure flap (23) is designed to be a part of an outer tab (28) of an end wall (16) of the pack. This part of the closure flap (23) is firmly connected to folding tabs of the end wall (16) disposed thereunder, so that the withdrawal opening (19) extends only up to a transverse edge (22).

10 Claims, 4 Drawing Sheets

PACKAGE FOR PAPER HANDKERCHIEFS

This is a Continuation of application Ser. No. 08/270,800, filed Jul. 5, 1994, now abandoned which is a continuation of U.S. application Ser. No. 07/992,820, filed Dec. 15, 1992 now abandoned.

BACKGROUND OF THE INVENTION

The invention relates to a package for stacks of folded tissues, especially paper handkerchiefs, having a wrapper made of paper, (plastic) foil or another flexible packaging material which surrounds the pack contents, and having a withdrawal opening disposed in the region of a rectangular front wall of the wrapper and directed towards an adjoining end wall, and with a closure flap covering the withdrawal opening in the closed position and extending into the end wall and being part of an outer tab of the end wall, with side tabs connected to elongated upright side walls being folded inwards into the plane of the end wall and being connected to further folding tabs of the end wall.

SUMMARY OF THE INVENTION

The invention is based on the object to provide a package, especially for paper handkerchiefs, which is suitable for all kinds of thin packaging material, including in particular paper or similar materials, without any danger of an undesired tearing or continued tearing in the region of the opening aid. Additionally, the package is intended to be designed such that it can be manufactured on an industrial scale with high capacity packaging machines.

To attain this object, the package according to the invention is characterized in that the side tabs are connected to the closure flap or the outer tab of the end to wall in such a way that when the side tabs are folded down into the plane of the end wall, folding gussets are formed in a region directed towards a rear wall, which gussets partially contact the inner side of the closure flap.

In the package or the blank according to the invention, the side tabs which adjoin the side walls of the package are connected to the outer tab of the end wall, i.e. they are not separated by punch cuts. As a result, multilayer folding gussets are formed during inward folding which add to the stability of the package in the region of the end wall and inhibit a tearing of the packaging material, even if it is an easily tearable material.

Furthermore, the withdrawal opening extends in the region of the front wall in a tongue-like manner and has, in accordance with the invention, a substantially smaller width than the front wall. Consequently, relatively wide webs remain next to the withdrawal opening in the region of the front wall. The side tabs are connected to these webs at least until the package is used for the first time. When the side tabs are folded down, (small) folding gussets are thus formed in the region of the front wall as well, which gussets are partially covered by the closure tab in the closed position of the package.

It is also important that, in accordance with the invention, a marginal strip of the side tabs which is directed towards the withdrawal opening is folded over, especially against the top side of tile side tabs. As a result, the withdrawal opening is extended into the end wall, which facilitates the withdrawal of the pack contents.

Further details of the invention will be described below with reference to the exemplary embodiment illustrated in the drawings, in which:

DESCRIPTION OF A PREFERRED EMBODIMENT

Figure 1:
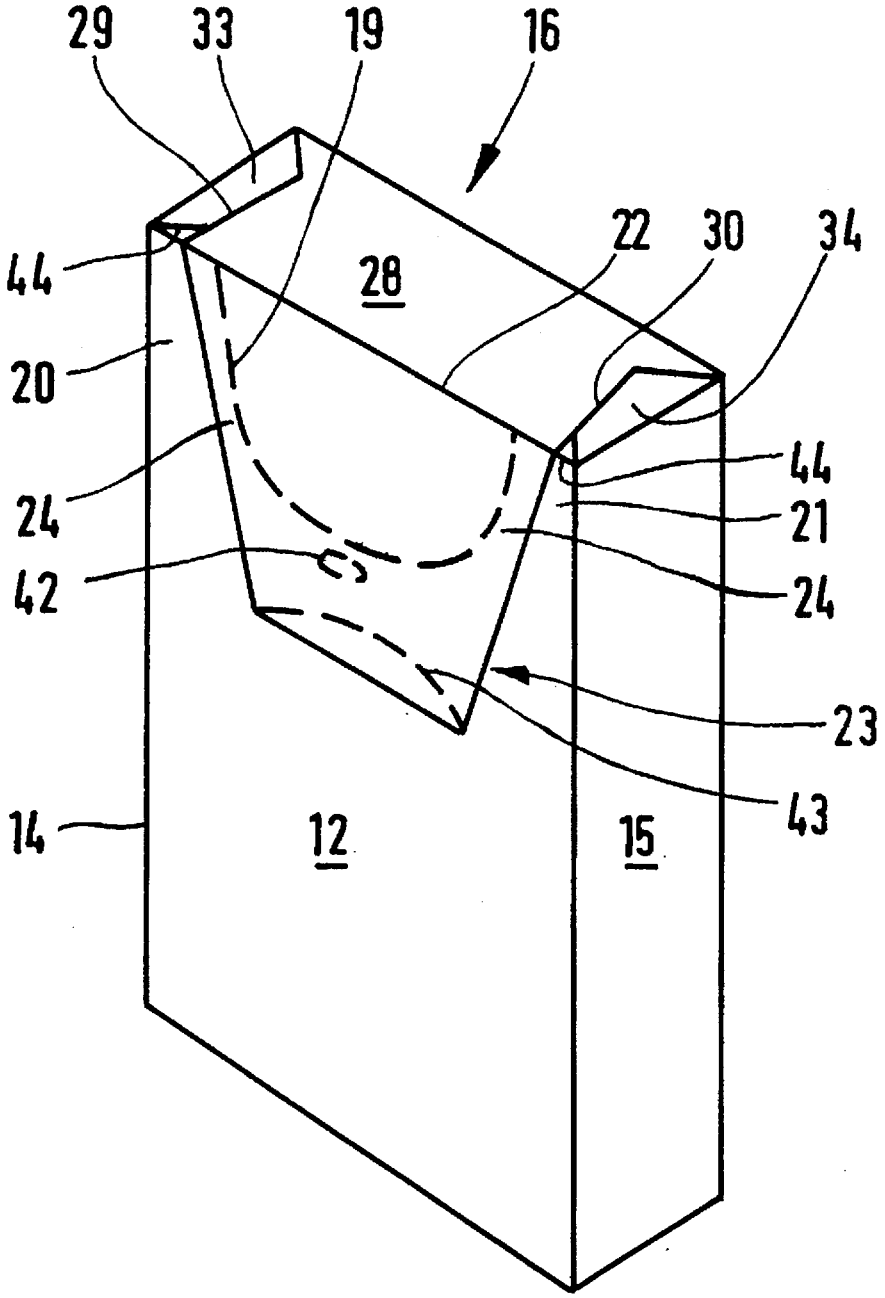
FIG. 1 shows a perspective view of a cuboid package for paper handkerchiefs in the closed position.

The exemplary embodiment illustrated is a cuboid soft pack for a stack of folded paper handkerchiefs 10 which are surrounded by an outer wrapper formed from a one-piece blank 11. Paper or paper-like materials, but also thin and highly flexible (plastic) foils may be used as packaging materials.

The wrapper or blank 11 forms a front wall 12, an opposite rear wall 13, elongated narrow side walls 14 and 15 and an end wall 16 with an oppositely situated bottom wall. The rectangular blank 11 wraps around the cuboid pack contents in a tubular manner. Two lateral wall tabs 17 and 18 overlap one another and form the side wall 15.

A withdrawal opening 19 for a withdrawal of the paper handkerchiefs 10 is formed in the region of the front wall 12 and the adjoining end wall 16. In this embodiment, the opening has a tongue-like shape with a rounded contour. The withdrawal opening 19 extends in an upper region of the front wall 12 which is directed towards the end wall 16 and in an adjoining marginal region of the end wall 16.

The withdrawal opening 19 is made by punching out a portion of the front wall 12 and is arranged and dimensioned in such a way that it has a substantially smaller width than the rectangular front wall 12. As a result, lateral webs 20, 21 remain and bound the withdrawal opening 19 in the region of the front wall 12. These webs 20, 21 extend up to an upper frontal transverse edge 22 which forms the transition between front wall 12 and end wall 16. The dimensions of the webs 20, 21 are defined such that they are approximately ⅙ of the overall width of the front wall which, in the case of a package with conventional dimensions, is 4 mm to 8 mm, for example.

In the closed position of the package, the withdrawal opening 19 is covered by a closure flap 23 and thus closed. The closure flap 23 has substantially greater dimensions than the withdrawal opening 19. As a result, projecting portions 24 of the closure flap 23 are formed relative to the withdrawal opening 19 on all sides in the closed position (FIG. 1). Consequently, the withdrawal opening is covered reliably, even if the closure flap 23 is not precisely aligned centrally relative to the withdrawal opening 19 as a result of manufacturing tolerances.

Figure 4:
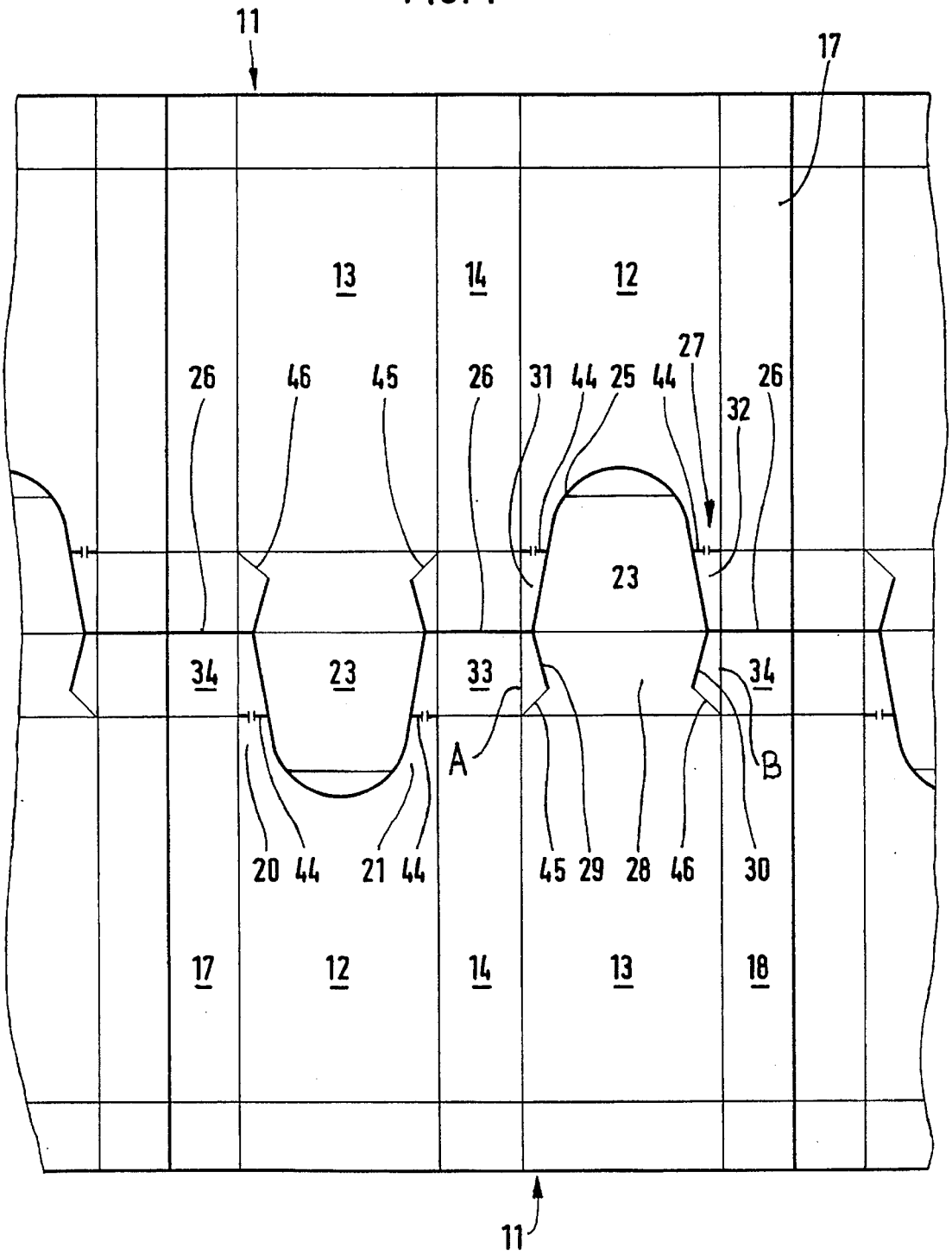
FIG. 4 shows a section of a web of material with blanks for the outer wrapper of the package of FIGS. 1 to 3.

The closure flap 23 has a tongue-like design and its shape and dimensions are adapted to the withdrawal opening 19. In the illustrated exemplary embodiment, this is accomplished by the arrangement of blanks 11 within a continuous web of material (FIG. 4). Two blanks 11 at a time are disposed next to one another within this web of packaging material.

Folding lines of the blanks are illustrated by thin lines and severing cuts in the packaging material are illustrated by thicker lines. The closure flap 23 of the one blank 11 which is connected to the rear wall 13 projects into the withdrawal opening 19 of the adjacent blank. Accordingly, a common punch cut 25 forms, on the one hand, the withdrawal opening 19 of the one blank and, on the other hand, the closure flap 23 of the other blank 11. The side-by-side blanks 11 are separated by central cuts 26 which are applied in the longitudinal direction of the web of material. A through cut severs the two blanks 11 from the web of material.

The closure flap 23 extends partly in the front wall 12 and, additionally, in the end wall 16 or in an inner tab 27 of the end wall 16 of the adjacent blank 11, and in an outer tab 28 of that blank 11 which is associated with the closure flap 23. In the presently described exemplary embodiment, the free portion of the closure flap 23, i.e. the portion which is severed from the adjacent blank 11, is formed with a varying width, namely a width which increases towards the transverse edge 22, as a result of the diverging configuration of the punch cut 25. The punch cut 25 is formed from converging punch legs or lateral margins 29, 30 in the region of the outer tabs 28 proximate the folding edges A and B (FIG. 4). These punch legs extend only over part of the width of the outer tab 28. Diverging folding lines 45, 46 which lead to rearward corners adjoin the ends of the punch legs 29, 30.

The width of the closure flap 23 is always smaller than the corresponding dimensions of the front wall 12 and the end wall 16. As a result, lateral marginal portions 31, 32 which are not covered by the closure flap 23 remain in the region of the end wall 16 as well.

The end wall 16 comprises the inner tab 27 or the remaining marginal portions 31, 32 of the inner tab 27, the outer tab 28 and side tabs 33, 34 located thereinbetween. The latter extend the side walls 14, 15, that is to say the wall tabs 17, 18. The side tabs 33, 34 are folded into the plane of the end wall 16 and form one layer of this end wall. The side tabs 33, 34 extend between inner tabs 27 and outer tab 28.

Figure 3:
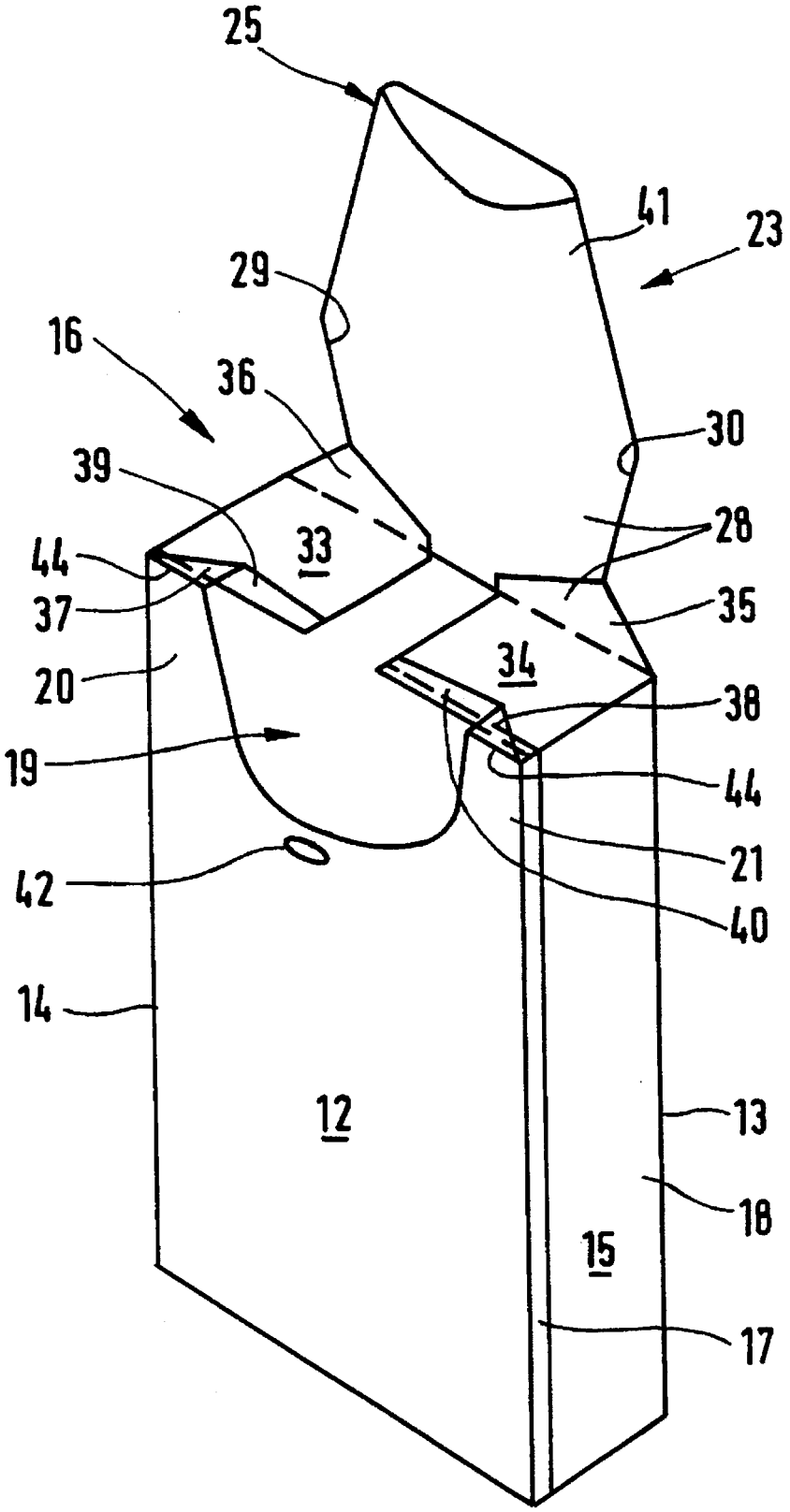
FIG. 3 shows a perspective view of the package during manufacture in an intermediately folded configuration.

The outstanding feature is that the side tabs 33 and 34 are not severed from the adjacent inner tabs 27 and outer tab 28 but are connected thereto by the folding edges A and B. As a result, triangular folding gussets 35, 36 are formed on the side which is directed towards the rear wall 13 when the side tabs 33, 34 are folded into the plane of the end wall 16 (position shown in FIG. 3). These gussets 35, 36 are part of the outer tab 28 and form a connection between the side tabs 33, 34 and the outer tab 28 or the closure flap 23. A portion of the folding gussets 35, 36 extends between the side tabs 33, 34 and the outer tab 28 or the closure flap 23 which forms a part of the outer tab 28 in this region.

As a result of the connection of the side tabs 33, 34 to the inner tab 27 or its marginal portions 31, 32, relatively small corner folds 37, 38 are formed at the opposite side which is directed towards the front wall 12. These corner folds 37, 38 are also folded against the top side of the side tabs 33, 34. In the exemplary embodiment illustrated, a marginal strip 39, 40 of the side tabs 33, 34 is additionally folded against the top side of the side tabs 33, 34. As a result, the withdrawal opening 19 is extended into the region of the end wall 16.

The finished package (FIGS. 1 and 2) is designed such that the closure flap 23, with its portion which extends in the region of the end wall 16, is firmly connected to the folding tabs of the end wall 16 which are located there-under, i.e. to the inwardly folded side tabs 33, 34. In this area, the closure flap 23 forms the outer tab 28 of the end wall 16. In the case of thermoplastic materials, this connection can be made by thermal sealing and in the case of paper and similar materials by adhesive bonding.

A free flap end 41 serves for opening and reclosing the package. The surface area of the flap end 41 is formed out of the inner tab 27 of the adjacent blank (FIG. 4) and that part of the closure flap 23, which is severed from the front wall 12 for the forming of the withdrawal opening 19. The transverse edge 22 at the same time forms an articulated axis or hinge for the flap end 41.

This part of the closure flap 23 covers the withdrawal opening 19 in the closed position (FIG. 1).

The flap end 41 of the closure flap 23 can be connected to the front wall 12 with an adhesive tape. In the presently described exemplary embodiment, an adhesive spot 42 made of a permanent adhesive is disposed below the withdrawal opening 19. This adhesive spot 42 releasably retains the closure flap 23 in the closed position. In the present case, the flap end 41 of the closure flap 23 is formed with an inwardly folded end piece 43 which is fixed in this position. This end piece 43 facilitates the grasping of the closure flap 23 when the package is opened and closed.

Figure 2:
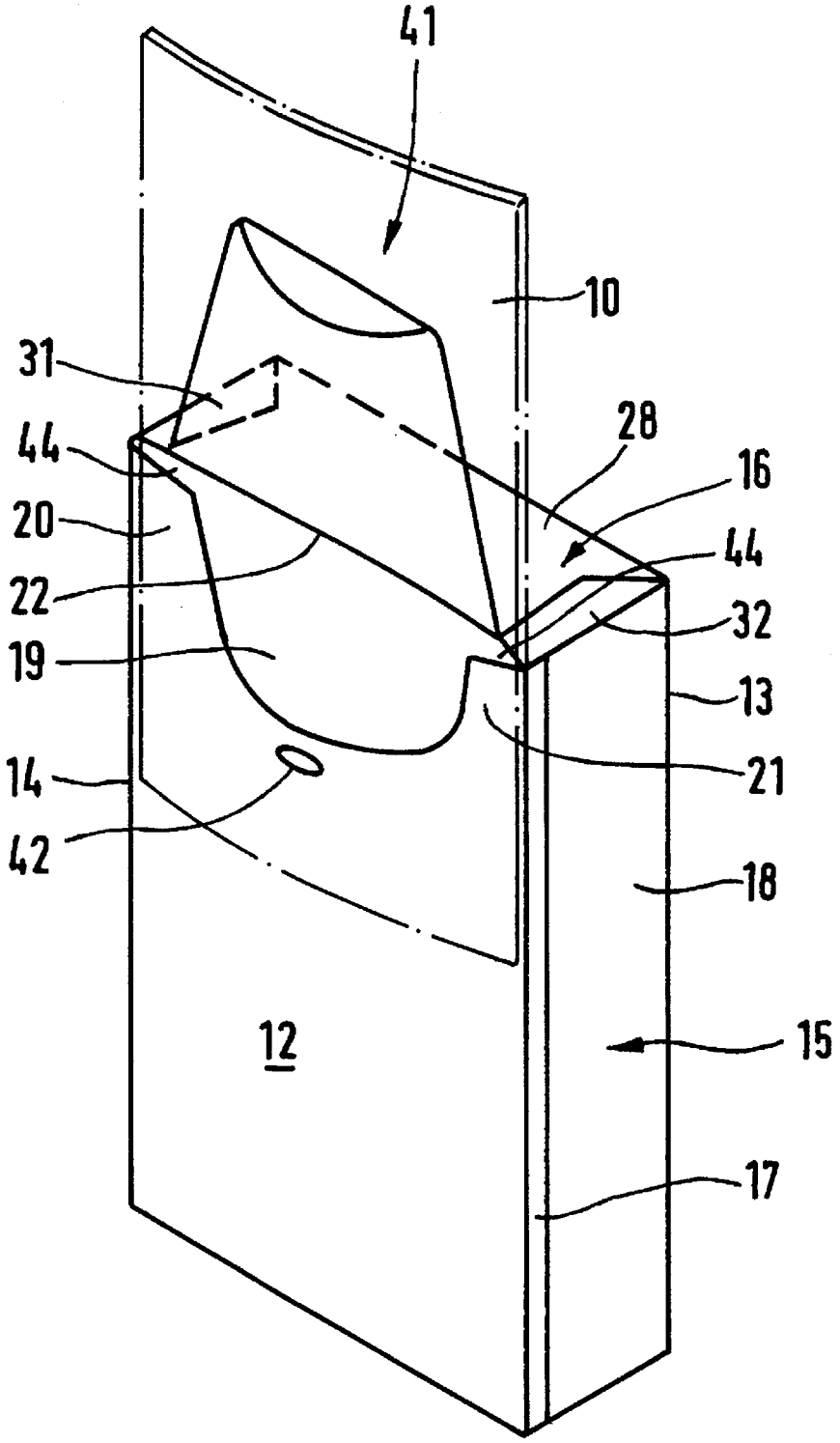
FIG. 2 shows a perspective view of the package of FIG. 1 in the open position for the withdrawal of a paper handkerchief.

The relatively wide webs 20, 21 which are located laterally next to the withdrawal opening 19 may impede the withdrawal of the paper handkerchiefs 10. Consequently, the webs 20, 21 are separated, in the region of the transverse edge 22, from the adjacent portion of the blank 11 which extends in the end wall 16, i.e. from the inner tab 27 or the marginal portions 31, 32 of the inner tab. A punch cut or, expediently, a perforation 44 may be formed in this region. This perforation is severed when the first and foremost paper handkerchief 10 is withdrawn. As a result, the withdrawal opening 19 is free over the entire width of the front wall 12 (FIG. 2).

What is claimed is:

1. A package, or a stack of folded tissues (10), having a wrapper made of paper or plastic foil which surrounds the stack, wherein:

a) the package is cuboidal with a large upright rectangular front wall (12), a rear wall (13), elongated upright side walls (14, 15), a bottom wall and an end wall (16);

b) the end wall (16) is formed from at least an outer tab (28) and from side tabs (33, 34), c) the outer tab (28) and the rear wall (13) form one piece, the outer tab (28) being a continuation of the rear wall (13);

d) each of the side tabs (33, 34) is a single-piece continuation of the respective adjoining one of said side walls (14, 15);

e) the front wall (12) has a tissue-withdrawal opening (19) located in a region adjoining the adjacent end wall (16);

f) a single-piece closure flap (23) extends, in a closed position, from the rear wall (13) over the end wall (16) and the withdrawal opening (19), and up into a region of the front wall (12);

g) the outer tab (28) forms a part of the closure flap (23) which is a single-piece continuation of the rear wall (13), such that a flap end (41), forming part of the closure flap (23) adjoins the outer tab (28), said flap end (41) being located, in the closed position, so as to rest in the region of the front wall (12), and said flap end covers the withdrawal opening (19);

h) in a first region adjoining each of the adjacent upright side walls (14, 15), each side tab (33, 34) is laterally connected to the outer tab (28); and i) in a position in which the side tabs are folded into a plane of the end wall (16), and with the outer tab (28) located in the plane of the rear wall (13), extensions of the side tabs (33, 34) directed towards the rearwall form folding gussets (35, 36) which are connected to the outer tab (28) by folding lines (45, 46) and rest against an inner side of the outer tab (28).

2. The package as claimed in claim 1, wherein each of the side tabs (33, 34) is separated from the outer tab (28) in a second region located at a distance from the respective side wall (14, 15).

3. The package as claimed in claim 1, wherein the folding lines (45, 46), starting from a corner point between side tabs, side wall and rear wall (34, 15, 13 and 33, 14, 13), extend obliquely and convergingly.

4. The package as claimed in claim 1, wherein lateral edges (29, 30) of the outer tab (28) adjoin the folding lines (45, 46) and extend, at first, divergingly, starting from the folding edges (45, 46).

5. The package as claimed in claim 1, wherein, in the region of the front wall (12), the withdrawal opening (19) has a substantially smaller width than the front wall (12), such that webs (20, 21) remain in the front wall (12) laterally next to the withdrawal opening.

6. The package as claimed in claim 5, wherein the flap end (41) has a smaller width than the front wall (12), but is wider than the withdrawal opening (19), such that the flap end (41) rests on the front wall (12) with projecting portions (24) around the withdrawal opening (19).

7. The package as claimed in claim 1, wherein each side tab (33, 34) has, at an edge directed towards the front wall (12), a marginal strip (39, 40) folded against the respective side tab (33, 34), such that an expansion of the withdrawal opening (19) is formed which extends in a region of the end wall (16).

8. The package as claimed in claim 5, wherein, in the region of the front wall (12), the side tabs (33, 34) are connected to the webs (20, 21) next to the withdrawal opening (19), and wherein, when the side tabs (33, 34) are folded into the plane of the end wall (16), corner folds (37, 38) are formed which rest on a top side of the side tabs (33, 34).

9. The package as claimed in claim 8, wherein the side tabs (33, 34) are connected to the webs (20, 21) via a perforation (44) and are severable from one another along the perforation.

10. The package as claimed in claim 1, wherein wrapper blanks (11) are severed from a web of material in which at least two wrapper blanks (11) are located next to one another, such that parts of the closure flap (23) of a wrapper blank (11) are cut out of an inner tab (27) and the front wall (12) of an adjacent blank (11), and wherein the closure flap (23) has a substantially smaller width than the inner tab (27) and the front wall (12).

* * * * *